US005740913A

United States Patent [19]

McFarland

[11] Patent Number: 5,740,913

[45] Date of Patent: Apr. 21, 1998

[54] POP-UP TISSUE DISPENSER

[75] Inventor: Timothy Maurice McFarland, Neenah, Wis.

[73] Assignee: Kimberly-Clark Worldwide, Inc., Neenah, Wis.

[21] Appl. No.: 695,485

[22] Filed: Aug. 12, 1996

[51] Int. Cl.[6] ..... B65D 73/00

[52] U.S. Cl. ..... 206/494; 206/459.5; 221/48; 221/50; 221/45

[58] Field of Search ..... 206/494, 233, 206/812, 459.5; 221/45, 47, 48, 50, 55

[56] References Cited

U.S. PATENT DOCUMENTS

| | | | |
|---|---|---|---|
| 1,219,239 | 3/1917 | Brown et al. | 270/39 |
| 1,579,429 | 4/1926 | Arms | 206/57 |
| 1,797,380 | 3/1931 | Thompson | 206/57 |
| 1,886,312 | 11/1932 | Stanton | 270/73 |
| 1,952,382 | 3/1934 | MacGregor | 206/57 |
| 2,080,729 | 5/1937 | McConnell | 206/57 |
| 2,085,882 | 7/1937 | Wandel | 206/57 |
| 2,656,916 | 10/1953 | Henderson | 206/57 |
| 2,761,676 | 9/1956 | Sabee et al. | 270/39 |
| 2,761,677 | 9/1956 | Rutkus et al. | 270/39 |
| 3,119,516 | 1/1964 | Donovan | 206/494 |
| 3,155,273 | 11/1964 | Cote | 221/48 |
| 3,207,361 | 9/1965 | Marcalus | 221/48 |
| 3,224,632 | 12/1965 | Marcalus | 221/48 |
| 3,819,043 | 6/1974 | Harrison | 206/494 |
| 3,986,479 | 10/1976 | Bonk | 221/47 |
| 4,181,225 | 1/1980 | Spiegelberg | 206/494 |
| 4,200,200 | 4/1980 | Hein, III et al. | 221/48 |
| 4,231,491 | 11/1980 | Pierson et al. | 221/48 |
| 4,513,862 | 4/1985 | Mallow | 206/494 |
| 4,574,952 | 3/1986 | Masui | 206/494 |
| 4,648,510 | 3/1987 | Kuenzel | 206/494 |
| 5,149,075 | 9/1992 | Crowley et al. | 270/39 |
| 5,295,579 | 3/1994 | Focke et al. | 206/494 |
| 5,368,188 | 11/1994 | Twardowski | 221/50 |
| 5,520,308 | 5/1996 | Berg, Jr. et al. | 221/50 |
| 5,531,325 | 7/1996 | Deflander et al. | 206/494 |
| 5,540,332 | 7/1996 | Kopacz et al. | 206/494 |

FOREIGN PATENT DOCUMENTS

| | | | |
|---|---|---|---|
| 0 253 308 A1 | 1/1988 | European Pat. Off. | B65D 83/08 |
| 0 365 055 A3 | 4/1990 | European Pat. Off. | G09F 3/10 |
| 2 269 425 A | 11/1975 | France | B42F 3/00 |

OTHER PUBLICATIONS

Patent Cooperation Treaty Search Report from the International Search Authority. International Application No. PCT/US 97/12448 dated Oct. 7, 1997.

*Primary Examiner*—David T. Fidei

*Attorney, Agent, or Firm*—Thomas M. Gage

[57] ABSTRACT

A pop-up tissue dispenser is provided for improved removal of a top tissue from a clip of tissues located within a carton. In one embodiment, a visually distinctive tissue has primary and secondary folds and a visual indicator disposed adjacent the secondary fold. Except for the presence of the visual indicator, the visually distinctive tissue is substantially identical to the other, substantially visually uniform tissues in the clip. In another embodiment, the visually distinctive tissue and the other tissues form a color interface that is visible through the carton opening prior to the removal of any tissues from the carton.

12 Claims, 7 Drawing Sheets

POP-UP TISSUE DISPENSER

BACKGROUND OF THE INVENTION

The present invention relates to tissue dispensers. More particularly, the invention pertains to an improved pop-up dispenser for tissue products, as well as a method and an apparatus for packaging tissues.

Pop-up style dispensers have been used for many years to dispense individual folded sheet products such as facial tissues or the like. In general, pop-up dispensers typically include a container and a stack or clip of prefolded interfolded tissues disposed within the container. The tissues may be C-folded or V-folded so that once the top tissue in the clip is withdrawn, subsequent sheets are individually presented for individual use.

One problem that has persisted through the years concerns the user being able to identify the proper location at which to grasp the top sheet to remove it through the opening in the container. Quite commonly with present commercial tissue containers, the user ends up tearing tissues, separating tissue plies, or dispensing multiple tissues when attempting to remove the top tissue. Furthermore, many commercial tissue dispensers include a plastic film over the opening of the container. Once the top tissue has been raised through a dispensing slit in the plastic film, subsequent tissues are held in an upright position by the plastic film for individual use. If the user has to search with his or her fingers to identify the proper location to grasp the top sheet, the plastic film can become distorted. Particularly with larger size containers, this may result in fall-backs, which refers to subsequent tissues dropping back down into the container rather than staying upright and ready for use.

A number of solutions have been proposed to address the problem of dispensing the top tissue in a pop-up dispenser. For example, it has been recommended that portions of the top sheet can be physically elevated, and thus, more readily identifiable from surrounding portions of the top sheet. It has also been suggested that the top sheet can be bonded to a removable panel of the carton, so that the top sheet is automatically raised through the opening when the panel is removed to form the opening. Other solutions to the problem have suggested adding separate strips within the stack of folded sheets, so that when the separate strips are pulled through the opening of the container, the top sheet is pulled through as well.

The foregoing and other proposed solutions attempting to facilitate proper removal of the top sheet in a pop-up dispenser have either been unsatisfactory or have created new problems. Most notably, past attempts to address the issue have increased the difficulty and/or expense of manufacturing pop-up dispensers, such as by adding new elements within the stack. Moreover, these past attempts to facilitate proper removal of the top tissue have not assisted the user in visually identifying the proper location at which to grasp the top sheet.

Therefore, what is lacking and needed in the art is an improved pop-up tissue dispenser that facilitates identification and removal of the top tissue without wasting tissue, and that can be economically manufactured.

SUMMARY OF THE INVENTION

In response to the discussed deficiencies in the prior art, a new pop-up tissue dispenser has been developed. The dispenser improves the ease at which tissue products are dispensed from a pop-up carton.

In one embodiment, a pop-up tissue dispenser includes a carton and a clip of tissues disposed within the carton. The carton has a plurality of walls that define a carton opening through which the tissues may be removed from the carton. The clip includes a visually distinctive tissue and a plurality of other tissues. The visually distinctive tissue and the other tissues are substantially identical except that the visually distinctive tissue includes a visual indicator. The visually distinctive tissue is oriented within the carton such that the visual indicator is visible through the carton opening prior to removal of any tissues from the carton.

This embodiment allows correct dispensing of tissues from the carton by providing visual identification of the best location for the user to grasp the first tissue in the carton. As a result, the user is able to easily dispense the top sheet and initiate the pop-up feature for the underlying sheets. This aspect saves the user from having to waste time examining the clip to determine a good place to initiate removal, and the improved dispensing eliminates wasting sheets on first dispensing. Also, the first tissue comes out easily without being torn and without distorting the plastic film covering the carton opening, if present.

The clip of tissues may be interfolded, prefolded interfolded, or non-interfolded. As used herein, the phrase "prefolded interfolded" tissues means that the tissues are folded and interleaved with neighboring tissues immediately above and/or below in the clip of tissues. The tissues can be interleaved by any suitable means, including the use of an interfolder as is well known in the papermaking arts. If an interfolder is used, consecutive tissues will be attached to each other at perforation lines. In such cases the unperforated segments of the perforation lines should be sufficiently weak to permit the consecutive tissues to separate from each other upon removal from the carton. This can be controlled by the degree of perforation of the tissue sheet. Tissues in a non-interfolded clip are not interleaved with neighboring tissues but are releasably attached to neighboring tissues so that upon dispensing one tissue the next adjacent tissue is then ready for dispensing. Suitable means for releasably attaching neighboring tissues in a non-interfolded clip include adhesives, mechanical engagement, ultrasonic bonds, thermal bonds, lap seals, fin seals, or the like, as is known in the art.

The term "visual indicator" is used herein to mean a continuous or intermittent pattern disposed directly on and/or in a tissue to visually identify for the user the best location to grasp a tissue to initiate dispensing. The pattern may consist of designs or symbols, such as alphanumeric characters, that are visually distinguishable by the human eye from surrounding regions of the tissue. The pattern is desirably formed of a color that stands out from the surrounding portions of the tissue and is clearly identifiable through any plastic film covering the opening to the container.

Other than the presence of the visual indicator on the visually distinctive tissue, the visually distinctive tissue and the other tissues are desirably substantially identical in all other material respects. Thus, the visually distinctive and other tissues are formed of essentially the same material and have the same basis weight, size and other visual properties as one another. Further, each of the other tissues is desirably substantially visually uniform, which as used herein means that any particular region of one of the other tissues is macroscopically indistinguishable from any other region of that tissue, and in particular that the other tissues are all of the same color. Point bonding between plies of tissue, fold lines, or the like, typically do not provide color differentiation to characterize a tissue as substantially visually non-uniform.

In another embodiment, a pop-up tissue dispenser includes a clip of interfolded tissues disposed within a carton. The clip includes a visually distinctive tissue and a plurality of other tissues. The visually distinctive tissue has primary and secondary folds and includes a visual indicator disposed adjacent the secondary fold. The other tissues have a primary fold and are substantially visually uniform. The visually distinctive tissue is oriented within the carton such that the visual indicator is visible through the carton opening prior to removal of any tissues from the carton.

In particular embodiments, the visual indicator is located less than about 2 centimeters, and more particularly less than about 1 centimeter, from the secondary fold, for improved performance. In other embodiments, the visual indicator has a length dimension greater than a width dimension, and the length dimension is oriented parallel to the secondary fold. The proximity and orientation of the visual indicator relative to the secondary fold facilitates identification of the proper location at which to grasp the top tissue.

In another embodiment, a pop-up tissue dispenser includes a clip of tissues disposed within a carton, and the clip includes a visually distinctive tissue and a plurality of substantially visually uniform other tissues. The visually distinctive tissue and the other tissues are substantially identical except that the visually distinctive tissue is a different color than the other tissues. The tissues are oriented within the carton such that the visually distinctive tissue and at least one of the other tissues are visible through the carton opening prior to removal of any tissues from the carton.

This embodiment utilizes a visually distinctive tissue that is a different color from the other tissues to facilitate correct dispensing of the first tissue from the carton. The visually distinctive tissue and one of the other tissues having a different color are both visible through the carton opening. The color interface that is formed on the user-facing surface of the clip indicates the best location for the user to grasp the first tissue in the carton. The term "different color" is used herein to refer to tissues that appear dissimilar to a user viewing the tissues through the carton opening, based on differing qualities of light reflected by the tissues.

Also in response to the above-noted deficiencies in the prior art, a new method of packaging tissues has been developed. The method includes the steps of: providing several tissue webs that are substantially identical to one another, the several tissue webs including a first tissue web and a plurality of other tissue webs; transporting the several tissue webs to a folding station; interfolding the several tissue webs at the folding station to form an interfolded assemblage of the first tissue web and the other tissue webs; printing a visual indicator on the first tissue web; cutting the interfolded assemblage to form a plurality of clips of interfolded tissues, each of the clips comprising a visually distinctive tissue having the visual indicator printed thereon and a plurality of other tissues that are substantially visually uniform; providing cartons for the clips, each carton comprising a plurality of walls that define therein a carton opening; and placing each clip in a carton and orienting the visually distinctive tissue such that the visual indicator is visible through the carton opening.

Further in response to the deficiencies in the prior art, a new apparatus for packaging tissues has been developed. The apparatus includes a web supply system adapted to provide several tissue webs that are substantially identical to one another. These several tissue webs include a first tissue web and a plurality of other tissue webs. A transport system is adapted to transport the several tissue webs to a folding station, where a folding device is adapted to interfold the several tissue webs to form an interfolded assemblage of the first tissue web and the other tissue webs. A printing device of the apparatus is adapted to print a visual indicator on the first tissue web. The apparatus also includes a cutting device adapted to cut the interfolded assemblage into a plurality of clips of interfolded tissues. Each of the clips includes a visually distinctive tissue having the visual indicator printed thereon and a plurality of other tissues that are substantially visually uniform. A packaging system of the apparatus is adapted to place each of the clips in a carton. Each carton includes a plurality of walls that define therein a carton opening, and the visually distinctive tissue is oriented within the carton such that the visual indicator is visible through the carton opening.

The disclosed method and apparatus provide an economical means to manufacture a pop-up tissue dispenser that provides convenient dispensing of the first tissue without waste. The visual indicator can be printed on the first tissue web either before or after formation of the interfolded assemblage. Thus, the printing operation can be continuously operated rather than having to discretely print on each clip.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION OF THE PREFERRED EMBODIMENTS

Figure 1:
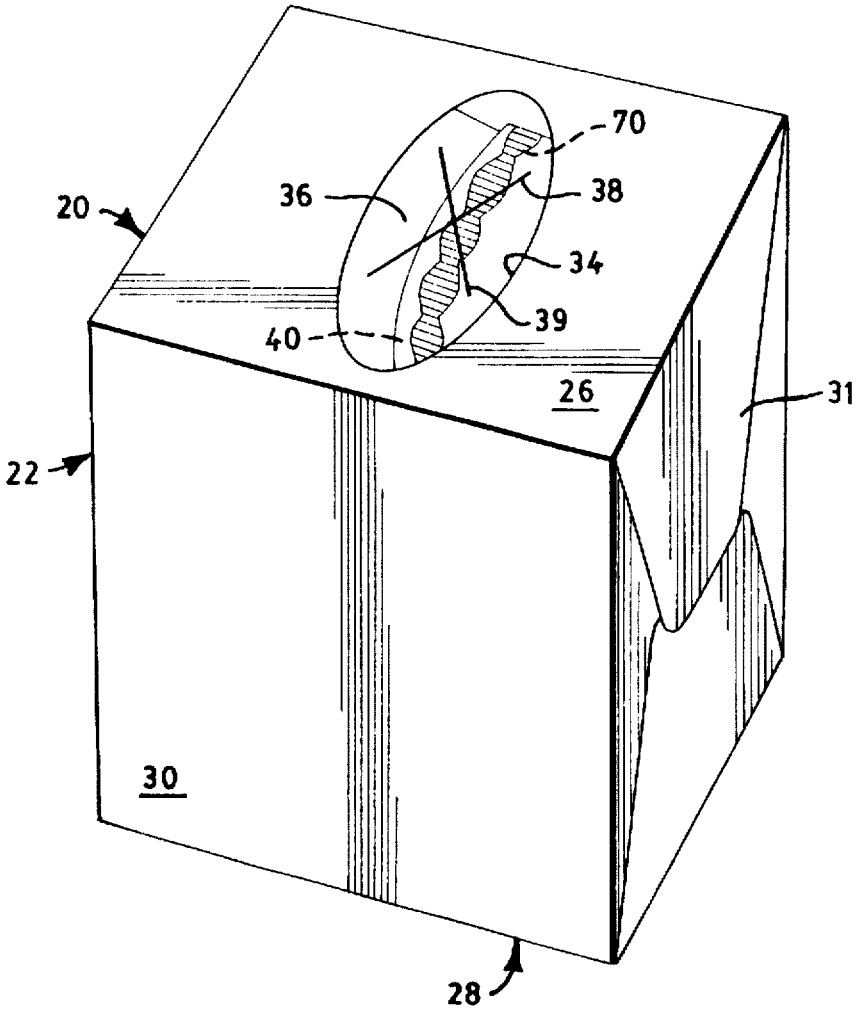
FIG. 1 representatively shows a perspective view of a carton of prefolded interfolded tissues illustrating one embodiment of the present invention.

With reference to FIG. 1, a pop-up tissue dispenser formed according to one embodiment of the present invention is shown for purposes of illustration as an upright, pop-up facial tissue dispenser 20. The invention may also be utilized to dispense other types of folded sheet products. Thus, the term "tissue" is not intended to be limited to facial tissues, but is used herein to include any individual sheet product, such as dry or moistened wipes, for example household or industrial wipes, soap or fabric softening sheets, or the like.

The tissue dispenser 20 includes a carton 22 and a clip 24 (FIG. 2) of prefolded interfolded tissues disposed within the carton. The carton 22 is illustrated as a rectangular parallelepiped comprising a top wall 26, and opposite bottom wall 28, and four sidewalls extending between the top and bottom walls. The sidewalls that are fully visible in FIG. 1 have been given reference numerals 30 and 31. The carton 22 may be constructed in a variety of sizes and shapes as are well known in the art from materials such as paperboard, plastic, or the like. For example, in an alternative embodiment the carton includes a single cylindrical-shaped sidewall extending between the top and bottom walls (not shown). Further, as illustrated in FIG. 1, any of the sidewalls such as sidewall 31 may be constructed of one or more panels that are bonded together by adhesives, thermal bonds, or other suitable means.

The top wall 26 of the carton 22 defines a carton opening 34 in the form of an aperture through which tissues may be individually removed from the carton. The carton 22 optionally includes a plastic film 36 overlaying the carton opening 34 and incorporating intersecting dispensing slits 38 and 39. The use of the plastic film 36 is desirable, particularly for larger carton openings, in order to protect the tissues within the carton and provide sufficient resistance to prevent multiple tissue dispensing. The plastic film 36 may be bonded to the top wall 26 by adhesives or other suitable means, and the dispensing slits 38 and 39 may assume other forms such as a single slit, an aperture or the like. The carton 22 may optionally be provided with a removable panel (not shown) that creates the carton opening when the panel is removed.

Figure 2:
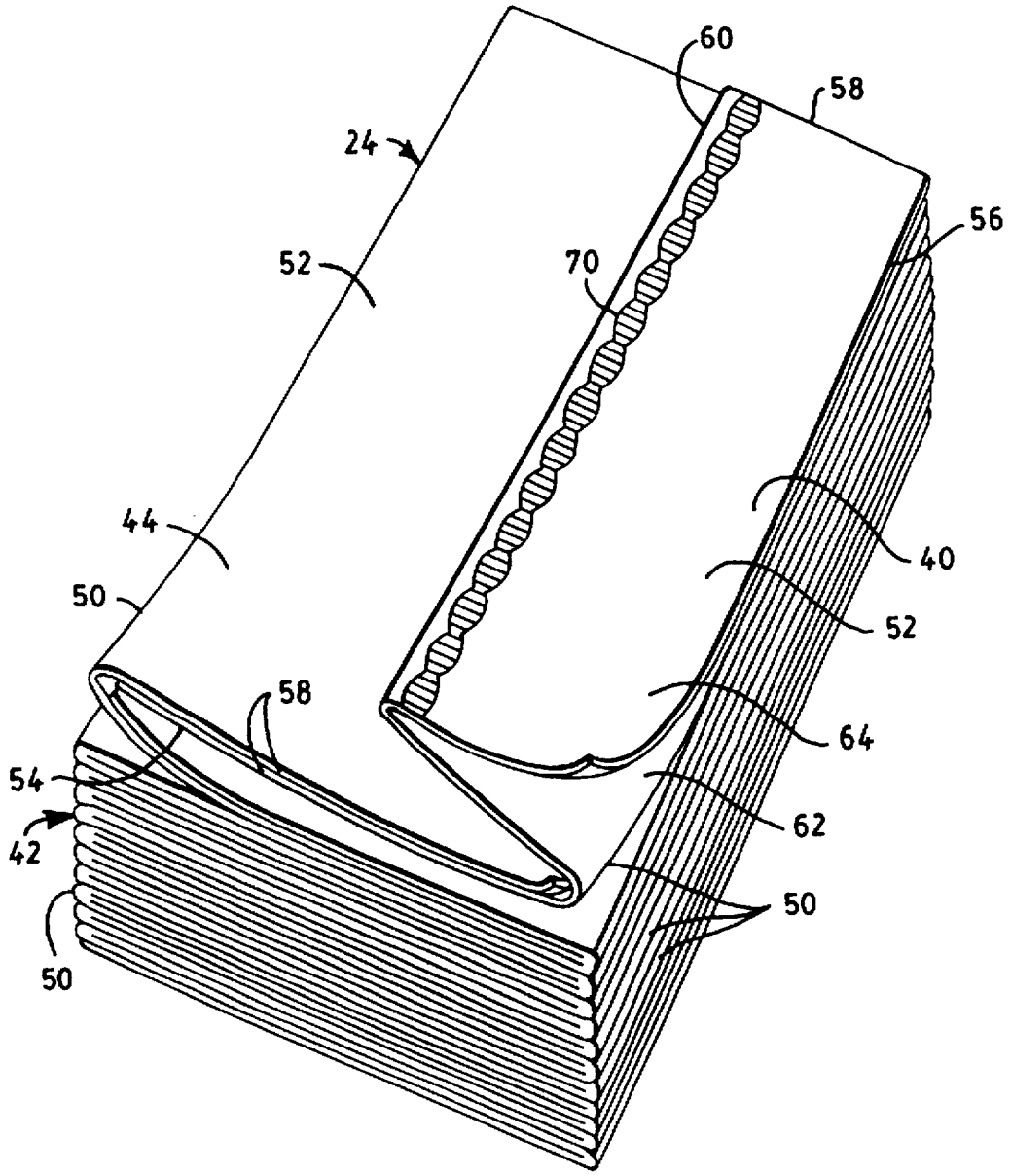
FIG. 2 representatively shows an enlarged perspective view of a clip of prefolded interfolded tissues such as those which could be longitudinally folded and placed in the carton shown in FIG. 1, with the first and second tissues in the clip slightly folded back to more clearly illustrate individual tissues.

An individual clip 24 of prefolded interfolded tissues is illustrated in FIG. 2. The clip 24 comprises a series of tissues beginning with a first tissue referred to herein as a visually distinctive tissue 40 and also including a plurality of other, underlying tissues 42. The underlying tissue 42 that is interfolded with the visually distinctive tissue 40 is referred to herein as a second tissue and has been given reference numeral 44. The visually distinctive tissue 40 and the second tissue 44 are partially raised with a corner turned back in FIG. 2 to better illustrate interfolding of the tissues.

Each of the visually distinctive and underlying tissues 40 and 42 has a primary fold 50 that divides the tissue into upper and lower halves 52 and 54. All of the tissues 40 and 42 include opposite longitudinal side edges 56 and opposite transverse end edges 58 that extend between the side edges. The primary fold 50 in the illustrated embodiment is formed generally parallel to and intermediate the longitudinal side edges 56.

The visually distinctive tissue 40, unlike the underlying tissues 42, also includes a secondary fold 60 formed in the upper half 52 of the tissue generally parallel to the primary fold 50. The secondary fold 60 divides the upper half 52 of the visually distinctive tissue 40 into an inner segment 62 disposed between the primary and secondary folds 50 and 60 and an outer segment 64 disposed between the secondary fold 60 and a longitudinal side edge 56.

Each of the visually distinctive and other tissues 40 and 42 are substantially identical in terms of material formation except that a visual indicator 70 is disposed on the visually distinctive tissue. The visual indicator 70 illustrated in FIG. 2 comprises a continuous, colored graphic design of alternating wide and narrow portions. The visual indicator 70 has a length dimension that is greater than a width dimension. The length dimension of the visual indicator 70 is oriented parallel to the secondary fold 60 and extends between the transverse end edges 58 of the visually distinctive tissue 40.

The visual indicator 70 is desirably located on the outer segment 64 of the upper half 52 less than about 2 centimeters (cm.) from the secondary fold 60. In particular embodiments, the visual indicator 70 is located less than about 1 cm. from the secondary fold 60 for improved performance.

The visual indicator 70 may be established on and/or in the visually distinctive tissue 40 by any suitable means such as rotogravure printing, non-contact printing, or other suitable means. The printing may utilize inks, dyes, adhesives, waxes, or the like.

The clip 24 and the visually distinctive tissue 40 are oriented within the carton 22 such that the visual indicator 70 is disposed adjacent the carton opening 34 and visible therethrough, prior to the removal of any tissues. If a plastic film overlays the carton opening 34, the plastic film desirably comprises a transparent material so that the visual indicator 70 is visible through the plastic film.

Figure 3:
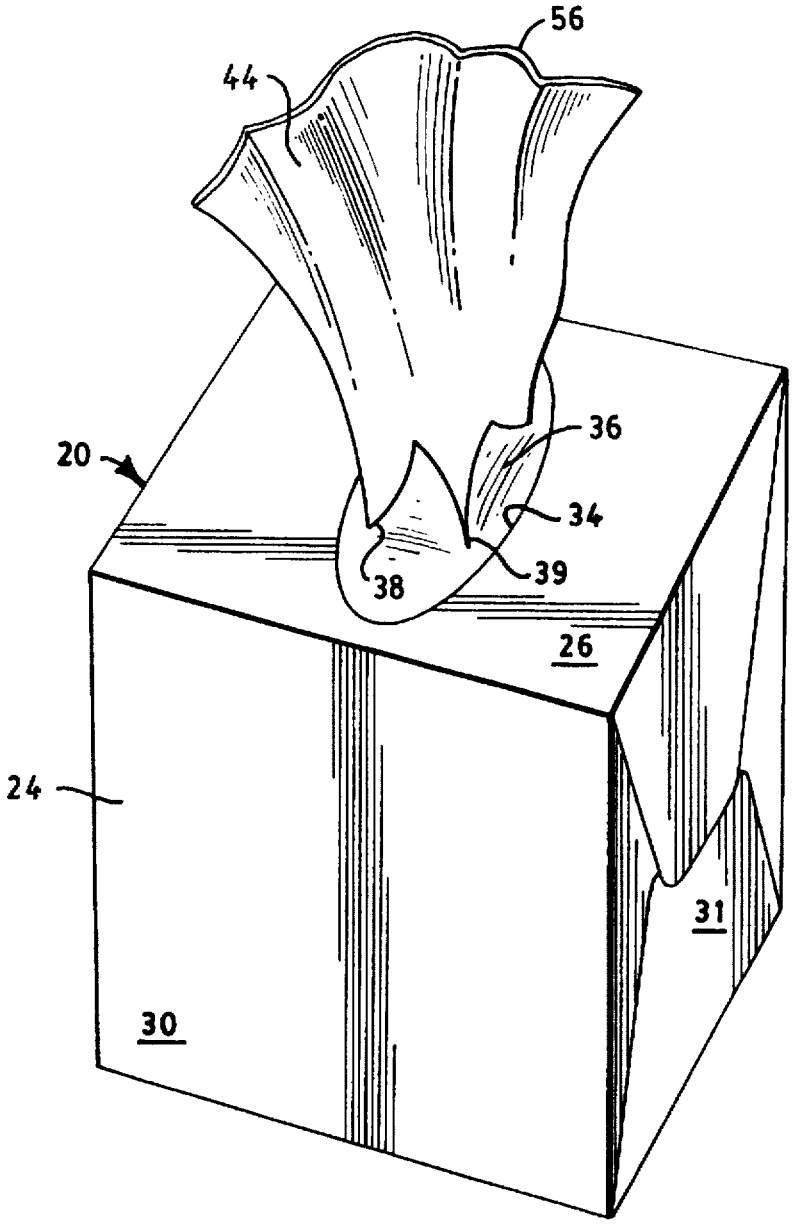
FIG. 3 representatively shows the carton of FIG. 1, with the first tissue having been removed from the carton.

In use, the user can locate the proper location at which to grasp the visually distinctive tissue 40 for removal by observing the location of the visual indicator 70. The user is guided by the visual indicator 70 to grasp the proximately positioned secondary fold 60 to remove the visually distinctive tissue 40 from the carton 22. As the visually distinctive tissue 40 is removed, the second tissue 44 is pulled through the dispensing slits 38 and 39 as a result of interfolding of the visually distinctive and second tissues. This pop-up dispensing feature is illustrated in FIG. 3 where the second tissue 44 is shown as being positioned for use and held in place by the plastic film 36. It will be appreciated as well by those skilled in the art that the top dispensing fold configuration could include two, three or more tissue instead of just one as illustrated. Alternatively, the tissues can be non-interfolded and releasably attached to one another sufficiently to enable pop-up dispensing.

Significantly, the other, underlying tissues 42 do not include the visual indicator 70, and as a result, they are considered to be substantially visually uniform. Thus, except for the composition of the visual indicator 70 on the visually distinctive tissue 40, the visually distinctive and underlying tissues 40 and 42 can beneficially consist essentially of the same materials in essentially the same configuration. The composition of the tissues will depend upon their intended function, as is well known to those skilled in the art.

The following Example is provided to give a more detailed understanding of the invention. The particular amount, proportions, compositions, and parameters are meant to be exemplary, and are not intended to specifically limit the scope of the invention.

A number of pop-up tissue dispensers were constructed comprising a flat-style carton with a clip of prefolded interfolded tissues disposed within the carton. A top wall of the carton defined a carton opening that was overlaid with a plastic film having a dispensing slit formed therein. The top tissue of the clip had primary and secondary folds, with the top tissue oriented within the carton such that the secondary fold was positioned beneath the carton opening.

All of the tissues were generally uniformly white in color and substantially identical except for a visual indicator that was printed on the top tissue adjacent the secondary fold. The visual indicator comprised a continuous band of repeating text reading "KLEENEX Leading Edge." The term "Kleenex" is a registered trademark of Kimberly-Clark Corporation, Neenah, Wis. The visual indicator was printed on the top tissue using an ink-jet non-contact printing system with light blue ink in 12 point type size. The visual indicator was longitudinally oriented parallel to the secondary fold and spaced within about 0.2 cm. of the secondary fold.

Figure 4:
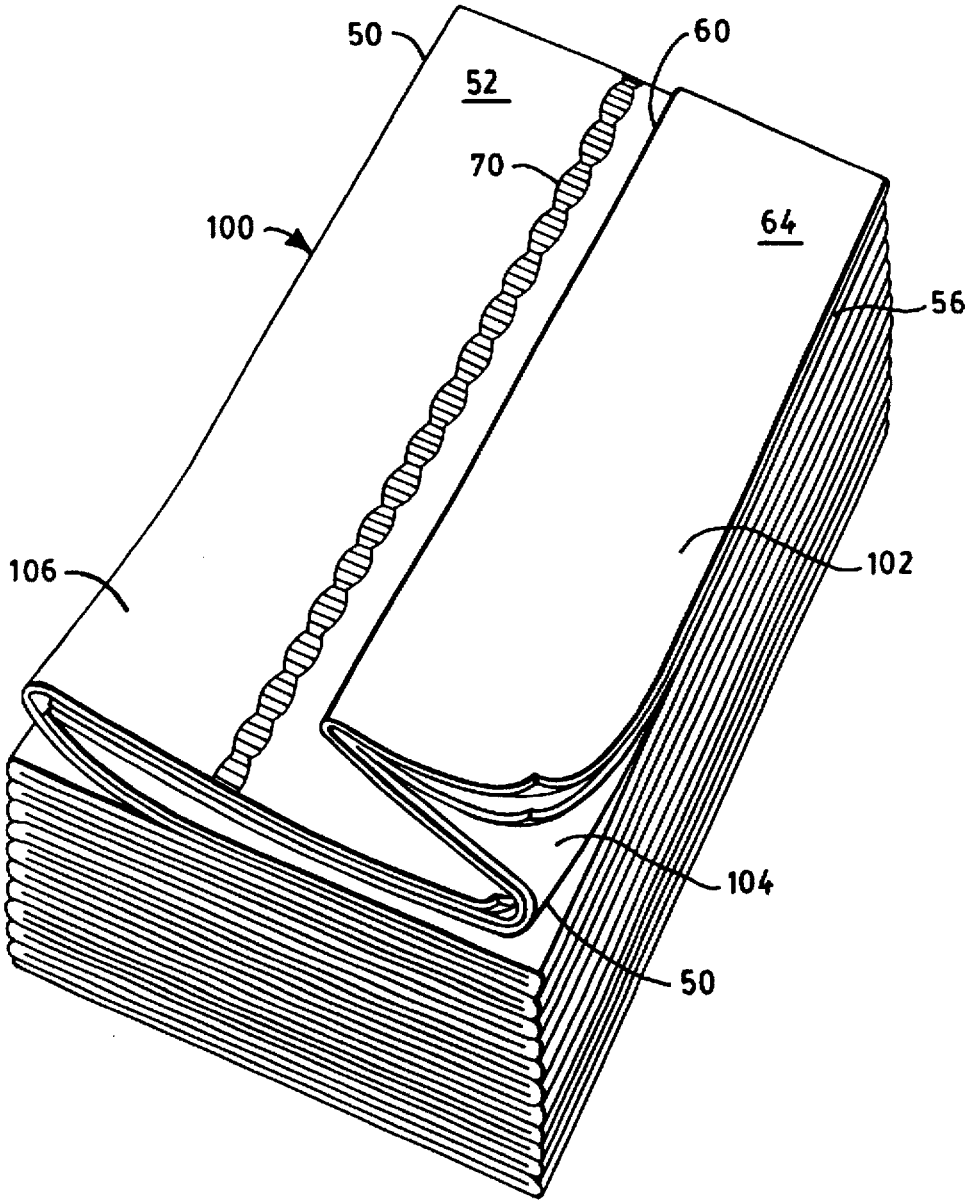
FIG. 4 representatively shows an alternative clip of prefolded interfolded tissues, with the first, second and third tissues in the clip folded back to more clearly illustrate individual tissues.

Various alternative embodiments are possible where the visual indicator 70 is not disposed on the first tissue in the clip 24. One such embodiment is illustrated in FIG. 4, wherein a clip 100 of prefolded interfolded tissues includes a first tissue 102 and a second tissue 104 in a so-called "double pop" arrangement. As used herein, the term "double pop" refers to the first two tissues of a clip being folded together in a common manner such that both tissues are removed from the carton at the same time to initiate dispensing of tissues from the carton. A third tissue in the clip 100 includes a visual indicator 70 and will therefore be referred to as the visually distinctive tissue 106. Desirably, the visually distinctive tissue 106 is located within the first 3 tissues of the first tissue.

The first and second tissues 102 and 104 include primary and secondary folds 50 and 60. The upper half 52 of the visually distinctive tissue 106 is disposed between the upper and lower halves 52 and 54 of the first and second tissues 102 and 104. The visual indicator 70 is desirably located adjacent the secondary fold 60 of the first and second tissues 102 and 104. In particular, the visual indicator 70 is desirably located within about 2 centimeters, and more particularly within about 1 centimeter, of the secondary fold 60 of the first and second tissues 102 and 104. Thus, the visual indicator 70 is not covered by the upper half 52 of the first and second tissues 102 and 104 and will be visible to the user through the carton opening 34 when the clip 100 is positioned in the carton 22. Despite the visually distinctive tissue 106 not being included in the top dispensing fold configuration, the close proximity of the visual indicator 70 to the secondary fold 60 of the first and second tissues 102 and 104 provides the necessary indication to the user of the proper location to grasp the folded edge on the user-facing surface of the clip 100.

Figure 5:
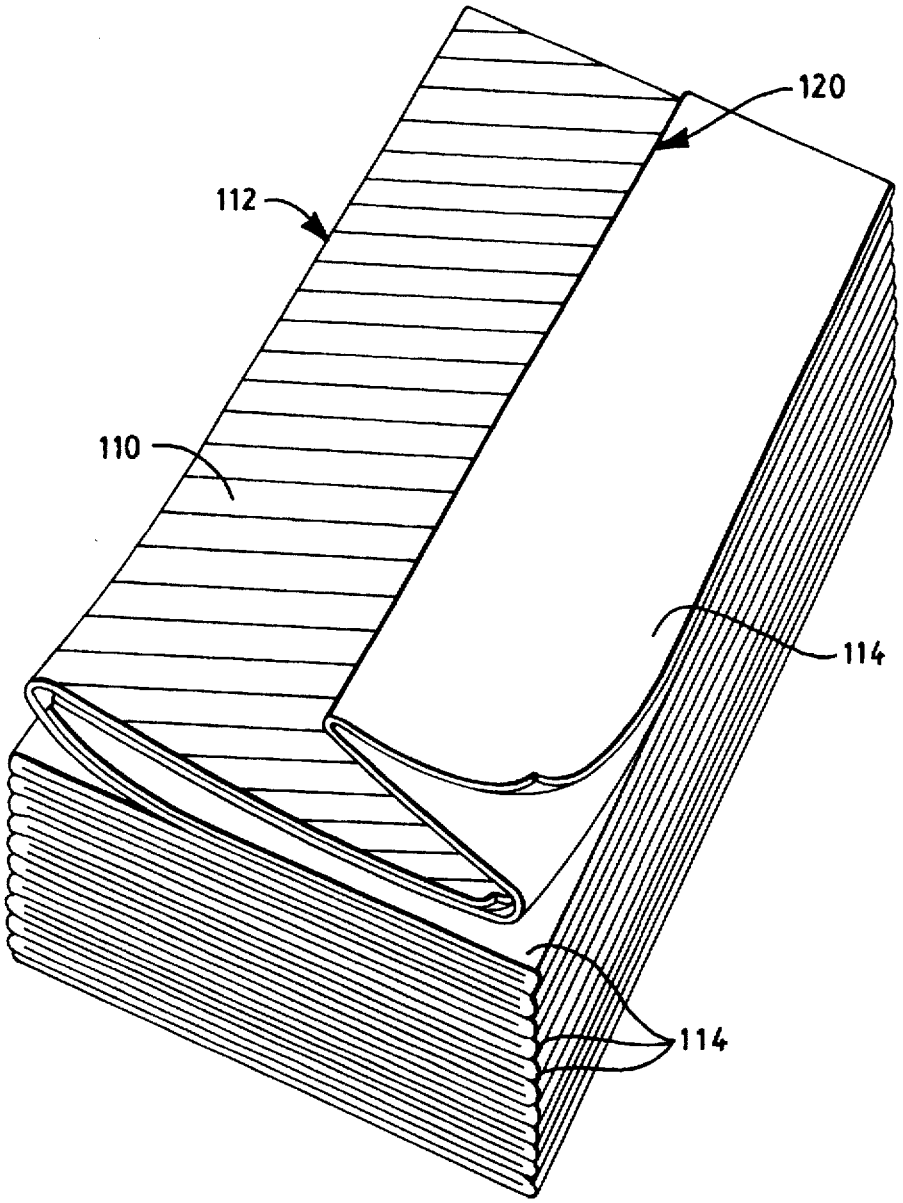
FIG. 5 representatively shows a further alterative clip of prefolded interfolded tissues, with the first and second tissues in the clip slightly folded back to more clearly illustrate individual tissues.

As illustrated in FIG. 5, a visually distinctive tissue 110 may also be obtained by incorporating a tissue that is of a different color than the other tissues. More specifically, a clip 112 of prefolded interfolded tissues includes a visually distinctive tissue 110 and a plurality of substantially visually uniform other tissues 114. The visually distinct tissue 110 and the other tissues 114 are desirably substantially identical except that the visually distinctive tissue is a different color than the other tissues. For example, the visually distinctive tissue 110 may be blue and the other tissues 114 may all be white. In the illustrated embodiment, the visually distinctive tissue 110 is the second tissue in the clip 112, although its position may be altered as discussed above in relation to the visually distinctive tissues of the previous embodiments.

The clip 112 is oriented within a carton 22 so that the visually distinctive tissue 110 and at least one of the other tissues 114 form part of the user-facing surface of the clip and are visible through the carton opening 34 prior to removal of any tissues from the carton. The different color of the visually distinctive tissue 110 and the other tissues 114 creates a color interface 120 that identifies for the user the best location to grasp the first tissue in the carton.

Figure 6:
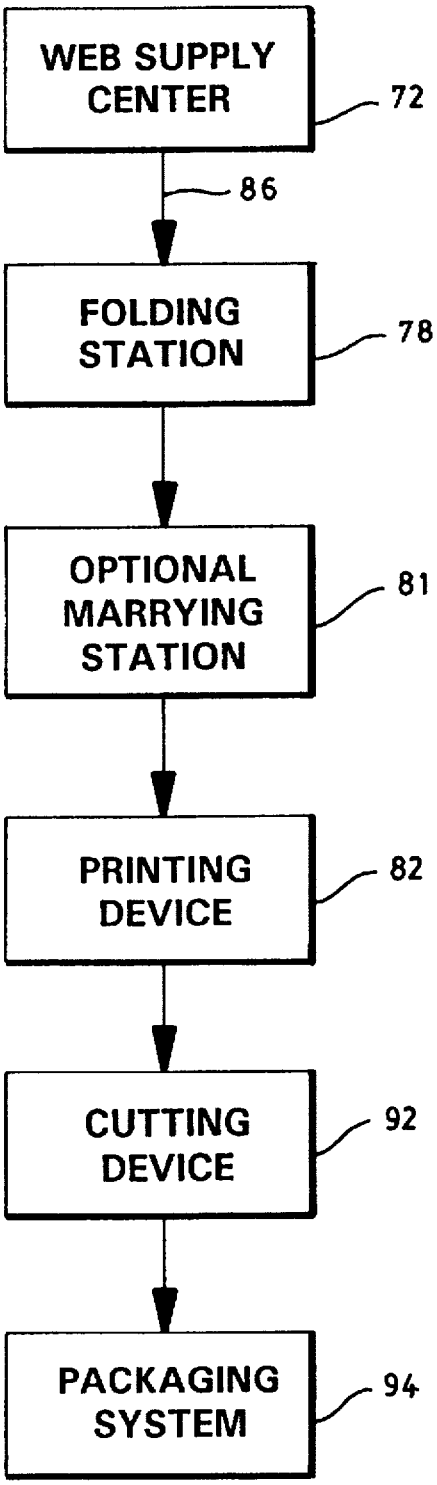
FIG. 6 representatively shows a schematic illustration of a method and apparatus for manufacturing cartons of the type illustrated in FIG. 1.

A particularly desirable method and apparatus for packaging tissues according to the present invention is schematically illustrated in FIG. 6. A web supply system 72 is adapted to provide several tissue webs 74 (FIG. 7) that are substantially identical to one another. The web supply system 72 may comprise, for example, a plurality of unwinds for dispensing roll product. The tissue webs 74 include a first tissue web 75 (FIG. 7) and a plurality of other tissue webs that are transported by a transport system 76 (FIG. 7) from the web supply system 72 to a folding station 78. The transport system 76 may comprise a plurality of conveyors, vacuum belts, or the like.

The tissue webs 74 converge at the folding station 78, where a folding device is adapted to prefold and interfold the tissue webs into an interfolded assemblage 80 (FIG. 7) of the first tissue web 75 and the other tissue webs. In one embodiment, the folding device provides each of the tissue webs with a primary fold 50 and additionally provides the first tissue web 75 with a secondary fold 60 (FIG. 2). The folding station 78 may function simply as an assembly station where the tissues are non-interfolded, as discussed previously.

The interfolded assemblage 80 may then be transported via the transport system 76 to an optional marrying station 81. The marrying station 81 may be employed to integrate the interfolded assemblage 80 with other interfolded assemblages (not shown) to form a final assemblage having the desired number of tissue webs. The marrying station 81 could alternatively be located later in the process or not be employed.

Figure 7:
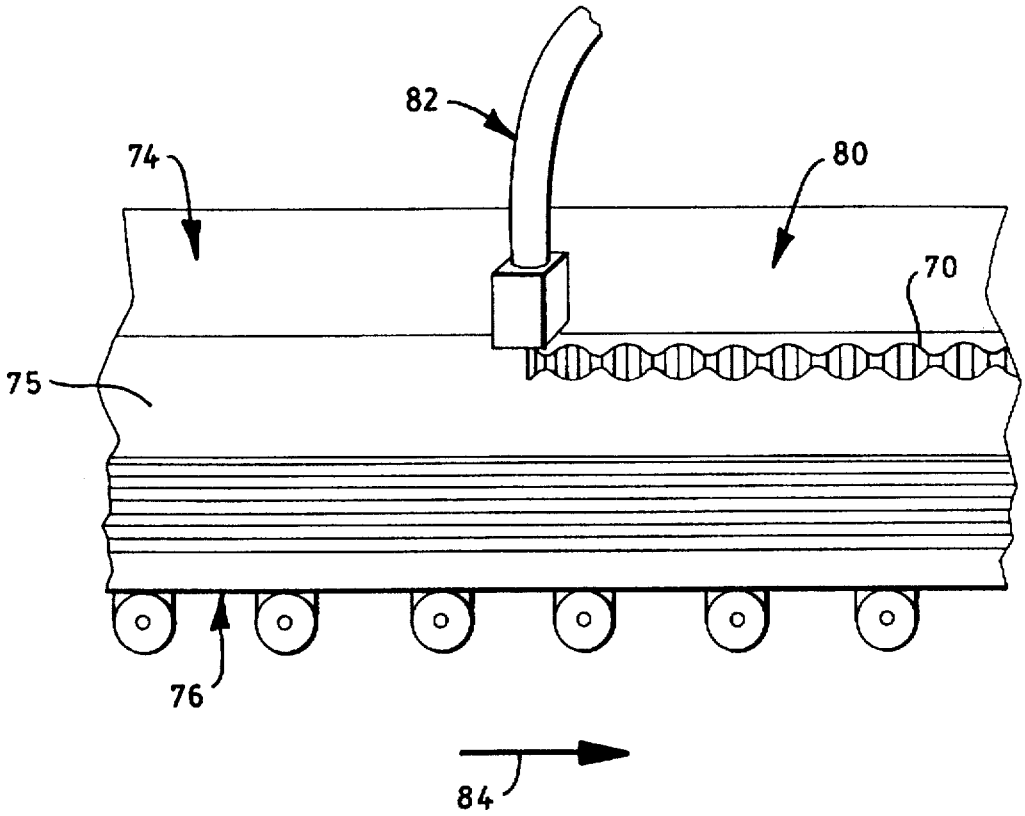
FIG. 7 representatively shows an enlarged perspective view of a printing device shown in block form in FIG. 6, the printing device functioning to print a visual indicator on a first tissue web of an in-process interfolded assemblage of multiple tissue webs.

The transport system 76 next conveys the interfolded assemblage 80 to a printing device 82, which is adapted to print a visual indicator 70 on the first tissue web 75. FIG. 7 representatively shows operation of the printing device 82 as the interfolded assemblage 80 passes beneath the printing device in the direction of arrow 84. One suitable printing device 82 is an ink jet printer available from Videojet Systems International, Inc. of Wood Dale, Ill. The printing device 82 may be located within the manufacturing process so that the visual indicator 70 is printed on the first tissue web 75 after formation of the interfolded assemblage 80. Alternatively, the printing device 82 may be located prior to the folding station 78, such as the alternative location designated reference numeral 86 in FIG. 6, whereby the visual indicator 70 would be printed on the first tissue web 75 before formation of the interfolded assemblage 80.

The complete assemblage is then transported to a cutting device 92. The cutting device 92 is adapted to cut the interfolded assemblage 80 into a plurality of clips 24 of prefolded interfolded tissues. The cut first tissue web 75 will form the visually distinctive tissue 40 of the clip 24 and will include the visual indicator 70. The individual clips 24 are taken by the transport system 76 to a packaging system 94 that is adapted to fold the clips if necessary and place each of the clips in a carton 22. The clips 24 and the visually distinctive tissue 40 are oriented within the carton 22 such that the visual indicator 70 is visible through the carton opening 34. The process and apparatus may be modified of course to change the location of the visually distinctive tissue 40 to other than the first tissue in the clip.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Therefore, the invention should not be limited by the specific embodiments described, but only by the claims.

I claim:

1. A pop-up tissue dispenser, comprising:

a carton comprising a plurality of walls defining therein a carton opening; and a clip of tissues disposed within the carton, the clip comprising a visually distinctive tissue and a plurality of other tissues, each of the visually distinctive and other tissues being substantially identical except that the visually distinctive tissue comprises a visual indicator, the visually distinctive tissue being oriented within the carton such that the visual indicator is visible through the carton opening prior to removal of any tissues from the carton.

2. A pop-up tissue dispenser, comprising:

a carton comprising a plurality of walls defining therein a carton opening; and a clip of interfolded tissues disposed within the carton, the clip comprising a visually distinctive tissue and a plurality of other tissues, the visually distinctive tissue having primary and secondary folds and comprising a visual indicator disposed adjacent the secondary fold, the other tissues having a primary fold and being substantially visually uniform, the visually distinctive tissue being oriented within the carton such that the visual indicator is visible through the carton opening prior to removal of any tissues from the carton.

3. A pop-up tissue dispenser, comprising:

a carton comprising a plurality of walls defining therein a carton opening; and a clip of tissues disposed within the carton, the clip comprising a visually distinctive tissue and a plurality of substantially visually uniform other tissues, each of the visually distinctive and other tissues being substantially identical except that the visually distinctive tissue is a different color than the other tissues, the visually distinctive tissue and the other tissues being oriented within the carton such that the visually distinctive tissue and at least one of the other tissues are visible through the carton opening prior to removal of any tissues from the carton.

4. The pop-up tissue dispenser of claim 1, wherein the other tissues are substantially visually uniform.

5. The pop-up tissue dispenser of claim 2, wherein the visual indicator is located less than about 2 cm. from the secondary fold.

6. The pop-up tissue dispenser of claim 5, wherein the visual indicator has a length dimension greater than a width dimension, and the length dimension is oriented parallel to the secondary fold.

7. The pop-up tissue dispenser of claim 1 or 2, wherein the visually distinctive and other tissues consist essentially of the same materials except for the visual indicator disposed on the visually distinctive tissue.

8. The pop-up tissue dispenser of claim 1, 2 or 3, wherein the clip consists of one visually distinctive tissue and a plurality of other tissues.

9. The pop-up tissue dispenser of claim 1 or 2, wherein the clip consists of one visually distinct tissue and a plurality of substantially visually uniform other tissues.

10. The pop-up tissue dispenser of claim 1 or 2, further comprising a plastic film formed of a transparent material overlaying the carton opening and defining therein a dispensing slit, the visual indicator being visible through the plastic film.

11. The pop-up tissue dispenser of claim 1, 2 or 3, wherein the clip comprises a series of tissues including a first tissue disposed toward the carton opening, and the visually distinctive tissue is located within 3 tissues of the first tissue.

12. The pop-up tissue dispenser of claim 11, wherein the visually distinctive tissue is the first tissue.

* * * * *